US005329077A

United States Patent [19]

Skalski et al.

[11] Patent Number: 5,329,077

[45] Date of Patent: Jul. 12, 1994

[54] ELEVATOR RIDE QUALITY

[75] Inventors: Clement A. Skalski, Avon; Randall K. Roberts, Amston, both of Conn.

[73] Assignee: Otis Elevator Company, Farmington, Conn.

[21] Appl. No.: 31,084

[22] Filed: Feb. 16, 1993

Related U.S. Application Data

[63] Continuation of Ser. No. 782,222, Oct. 24, 1991, abandoned.

[51] Int. Cl.[5] ..... B66B 3/00; B66B 7/02

[52] U.S. Cl. ..... 187/133; 187/1 R; 187/115; 187/95; 105/182.1; 104/129

[58] Field of Search ..... 187/1 R, 115, 95, 133; 105/182.1; 104/129

[56] References Cited

U.S. PATENT DOCUMENTS

| | | | |
|---|---|---|---|
| 3,099,334 | 7/1963 | Tucker et al. | 187/95 |
| 3,669,222 | 6/1972 | Takamura et al. | 187/95 |
| 3,939,778 | 2/1976 | Ross et al. | 105/182.1 |
| 4,215,403 | 7/1980 | Pollard | 318/424.05 |
| 4,750,590 | 6/1988 | Otala | 187/95 |
| 4,754,849 | 7/1988 | Ando | 187/95 |
| 4,809,179 | 2/1989 | Klinger et al. | 364/424.05 |
| 4,892,328 | 1/1990 | Kurtzman et al. | 280/707 |
| 4,898,257 | 2/1990 | Brandstadter et al. | 180/9.1 |
| 4,899,852 | 2/1990 | Salmon et al. | 187/1 R |
| 5,020,639 | 6/1991 | Michel | 187/1 R |
| 5,027,925 | 7/1991 | Kahkipuro | 187/115 |
| 5,086,882 | 2/1992 | Sugahara et al. | 187/95 |

FOREIGN PATENT DOCUMENTS

| | | | |
|---|---|---|---|
| 0033184 | 8/1981 | European Pat. Off. | B66B 7/04 |
| 0467673 | 1/1992 | European Pat. Off. | B66B 11/02 |
| 60-15374 | 1/1985 | Japan | B66B 1/06 |
| 60-36279 | 2/1985 | Japan | B66B 7/04 |
| 61-22675 | 6/1986 | Japan | B66B 7/08 |
| 3-23185 | 1/1991 | Japan | B66B 11/02 |
| 3-51280 | 3/1991 | Japan | B66B 5/02 |
| 3-51281 | 3/1991 | Japan | B66B 5/02 |
| 3-115076 | 5/1991 | Japan | B66B 1/06 |
| 3-124683 | 5/1991 | Japan | B66B 7/02 |
| 2238404 | 5/1991 | United Kingdom | B66B 7/02 |

OTHER PUBLICATIONS

*Development of an Inertial Profilometer*, E. L. Brandenburg, et al, Distributed by National Technical Information Service, U.S. Department of Commerce, Nov. 1974.

*Inertial Profilometer as a Rail Surface Measuring Instrument*, T. J. Rudd and E. L. Brandenburg, published by American Society of Mechanical Engineers, New York, N.Y., Sep. 1973.

"Performance of Magnetic Suspension for High-Speed Vehicles" by C. A. Skalski, Journal of Dynamic Systems, Measurement & Control, Jun. '74.

Patent Abstracts of Japan-Kokai 3-51280.

Patent Abstracts of Japan-Kokai 3-115076.

Patent Abstracts of Japan-Kokai 3-124683.

*Primary Examiner*—Steven L. Stephan

*Assistant Examiner*—Robert Nappi

*Attorney, Agent, or Firm*—Francis J. Maguire, Jr.

[57] ABSTRACT

Rail learning is combined with feedback in a control for improving ride quality in an elevator. For example, a pre-stored signal indicative of a horizontal deviation of the rail's surface from a vertical reference is retrieved and used along with a sensed signal indicative of a horizontal position (or other parameter indicative of a disturbance of the elevator) relative to the rail's surface (or a reference) for controlling an actuable horizontal suspension for reducing horizontal disturbances of the elevator while guiding an elevator vertically in a hoistway along a rail. As another example, a sensed force signal is averaged over a plurality of trips under differing load conditions and the average is pre-stored for retrieval at various vertical points in the hoistway and may be used, in combination with a feedback loop, to predict horizontal forces about to act on the car.

6 Claims, 5 Drawing Sheets

*fig. 8*
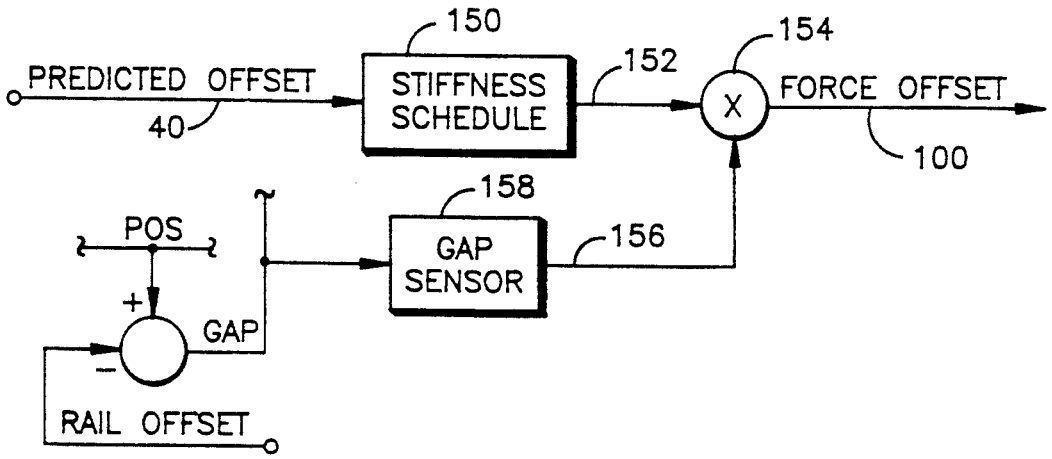
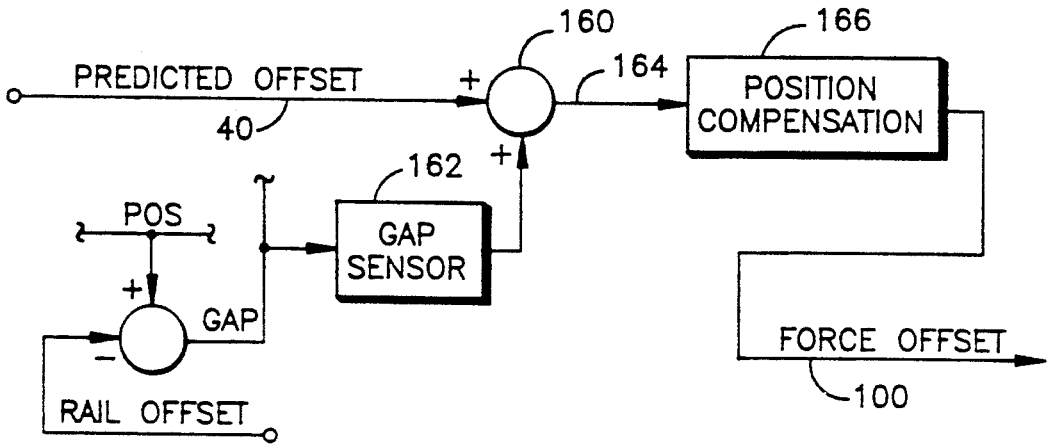
*fig. 9*

ELEVATOR RIDE QUALITY

This is a continuation of copending application(s) Ser. No. 07/782,222 filed on Oct. 24, 1991 now abandoned.

TECHNICAL FIELD

The invention relates to elevators and, more particularly, to improved ride quality.

BACKGROUND ART

U.S. Pat. No. 4,750,590 to Otala shows an open-loop elevator control system with solenoid actuated guide shoes. The disclosure suggests using the concept of first ascertaining the out-of-straightness of the guide rails for storage in a computer memory and subsequently controlling the guide shoes by recalling the corresponding information from memory and correcting the guide rail shoe positions accordingly.

Kokai 3-51281 of Kagami is similar to Otala except is additionally concerned with a supposed variable stiffness of the rails along with an eccentric load causing difficulties in truly learning the rail. See also Kokai 3-23185, 3-51280 and 3-115076 for similar disclosures. Kokai 3-124683 shows apparatus for measuring the mounting accuracy of a guide rail by sensing the position of the car relative to a piano wire and a rail.

Kokai 60-36279 discloses an electromagnet guide in a closed loop control based on position and current feedback. The text that explains FIG. 8 seems to suggest memorizing rail displacement error.

U.S. Pat. No. 4,754,849 to Ando and Kokai 58-39753 show electromagnet guides using a vertical wire as a positional reference.

U.S. Pat. No. 5,027,925 shows a procedure for damping the vibrations of an elevator car supported by elastic suspension elements and controlling a vibration damper in parallel with the elastic suspension elements with the output of an acceleration sensor. See also Kokai 61-22675 for a disclosure of variable coulomb-damping in parallel to the car top hitch springs which carry the rope loads suspending the crosshead. See also Kokai 60-15374 for a similar device for controlling vertical vibrations using an accelerometer in FIG. 11. Various other patent documents disclose acceleration-based, closed-loop "active" suspensions for automobiles, railroad cars, military tanks, etc. See, e.g., U.S. Pat. Nos. 4,809,179; 4,892,328 and 4,898,257. Similarly, a real time simulation was used to analyze two idealized MAGLEV suspensions: an attraction (ferromagnetic) system and a repulsion (cryogenic) system in "Performance of Magnetic Suspension for High-speed Vehicles" by C. A. Skalski, published in the June 1974 *Journal of Dynamic Systems Measurement and Control.* FIG. 8 thereof shows an accelerometer connected to an integrator.

An active horizontal suspension is disclosed in United Kingdom Patent Application GB 2 238 404 A, having pressure applied to the guide rails sensed at a stop and maintained constant at the stopped value by driving actuable guides in a feedback loop with the outputs of a pressure or displacement sensor.

DISCLOSURE OF INVENTION

According to the present invention, a rail learning technique is combined with a feedback control technique for improving ride quality in an elevator.

In U.S. patent application Ser. No. 07/555,130 and related cases filed at the same time, techniques for using accelerometers in a feedback loop were fully disclosed for controlling disturbances acting on an elevator. These closed loop techniques have the advantage of being self-adjusting.

A potential problem with the accelerometer feedback method is getting sufficient stable closed loop bandwidth. For a full discussion of the required gains, see the above mentioned application and also U.S. patent application Ser. No. 07/731,185. Structural resonances, etc., can limit the achievable closed loop system bandwidth.

Moreover, for some applications, such as for long wheelbase cars, it may be desirable to separate accelerometers from actuators to reduce vibrations at a selected point such as at the floor level. Such, however, can destabilize the control at higher gains. Though it would be desirable to avoid it, an on-site adjustment by a highly skilled controls engineer might sometimes be required.

In U.S. patent application Ser. No. 07/688,544, filed 13 March 1991 and a related case (Ser. No. 07/668,546) filed the same day, a detailed showing was made as to how to learn the rail profile using an accelerometer and a position sensor. Other methods are certainly possible with one additional method shown below. Regardless of the rail learning technique used, the present invention uses such learned information in an open loop along with a feedback loop to reduce vibrations.

A potential problem with the open loop method, using learned rail data, is getting sufficient measurement accuracy. With careful tuning, on a two-axis laboratory device, a 40:1 reduction in vibration level has been demonstrated. On the other hand, one estimate of that which is commercially achievable, i.e., on a repeatable basis in actual hoistways, with control of both the top and bottom of the car, is an improvement of 10:1 (with high accuracy hardware). Another estimate, using only control at the bottom of the car, is an improvement of perhaps 3:1.

For a desired level of improvement, say on the order of 10:1 or better, by combining an open-loop, rail learning approach with a closed-loop, sensor-based approach, the burden on either control loop used alone drops from 10:1 or better, to less than 4:1 each. It is thus important to realize that the improvement effect of combining the two control loops is multiplicative rather than merely additive. In the combined approach, the gain demand on the feedback loop is thus much lower and the need for accuracy of the open-loop components much less stringent.

These and other objects, features and advantages of the present invention will become more apparent in light of the following detailed description of a best mode embodiment thereof, as illustrated in the accompanying drawing.

BRIEF DESCRIPTION OF THE DRAWING

FIGS. 8 and 9 shows alternative methods to the method shown in FIG. 5 for providing a force offset signal according to the present invention.

BEST MODE FOR CARRYING OUT THE INVENTION

Figure 1:
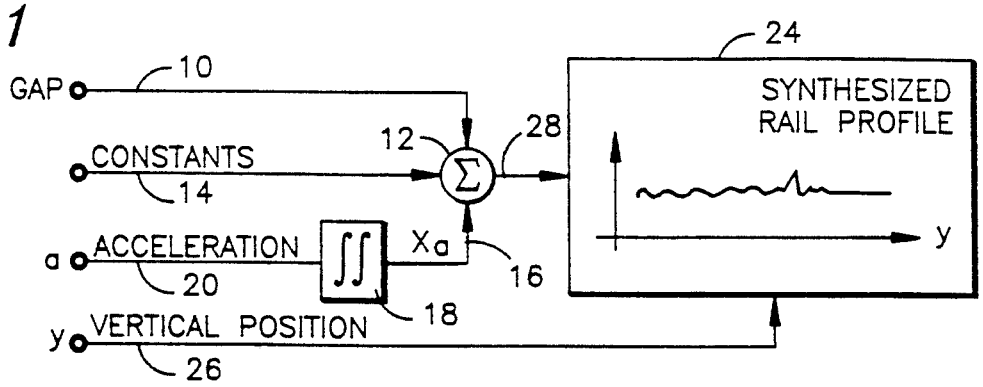
FIG. 1 shows a rail profile learning technique according to the present invention.

FIG. 1 shows a rail profile learning technique in which the horizontal position of the car with respect to a reference is measured and a signal (GAP) on a line 10 is provided for summation in a summer 12 with a signal on a line 14 representing constants. Also summed in junction 12 is a signal ($x_a$) on a line 16 from a double integrator 18 fed by a sensed acceleration (a) signal on a line 20 indicative of acceleration of an elevator car with respect to an inertial reference. A synthesized rail profile 24 may be created more or less continuously or by sampling along the length in a hoistway. Thus, for each vertical position as indicated by a signal on a line 26, a summed signal on a line 28 may be correspondingly sampled and stored in a synthesized rail profile table with the magnitude of the vertical position signal on the line 26 stored in a pair with the magnitude of the signal on the line 28.

Figure 4:
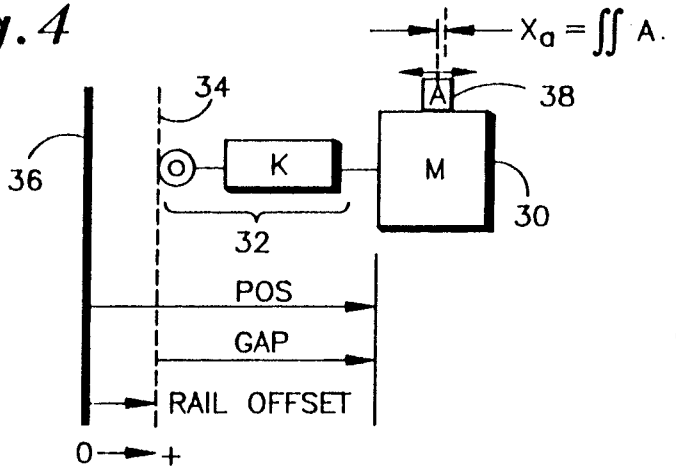
FIG. 4 graphically shows the relationship of some of the parameters of FIGS. 1, 2 & 3 according to the present invention.

The relationships of these signals are shown in FIG. 4 in detail where an elevator car 30 is suspended in a hoistway and is guided vertically therein by a guide, which is shown, without limitation, in FIG. 4 as an actuable roller guide 32, riding on a surface of a rail 34 mounted to a hoistway wall 36. An accelerometer 38 is mounted on the car 30 and measures the side-to-side horizontal acceleration of the car 30.

It should be realized that the method shown in FIG. 1 is merely one way to gather rail information. Another method is shown below in connection with FIG. 1A. Thus, although we show two such methods, the rail learning technique utilized to "memorize the rail" is not the point of the present invention. Rather, we teach the utilization of such stored information relating to the rail in an open loop control in combination with a closed loop control.

Figure 2:
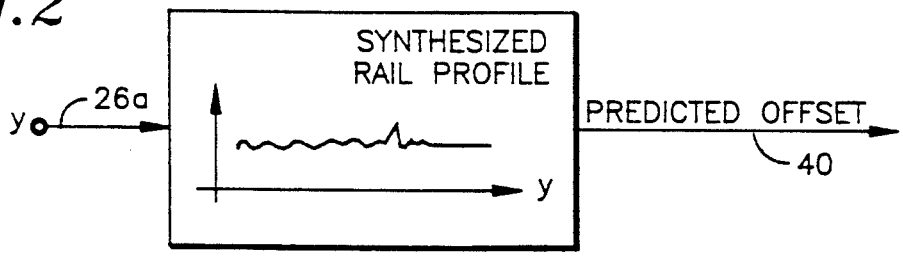
FIG. 2 shows retrieval of learned rail profile data in response to a vertical position signal according to the present invention.

Referring now to FIG. 2, for this particular example, once a rail profile is synthesized and stored in a memory, the stored data can then be retrieved depending on the vertical position of the car in the hoistway to predict the rail offset. In other words, at a given position as indicated by a signal on a line 26*a*, a predicted offset signal on a line 40 is retrieved from memory and provided for control purposes.

Figure 3:
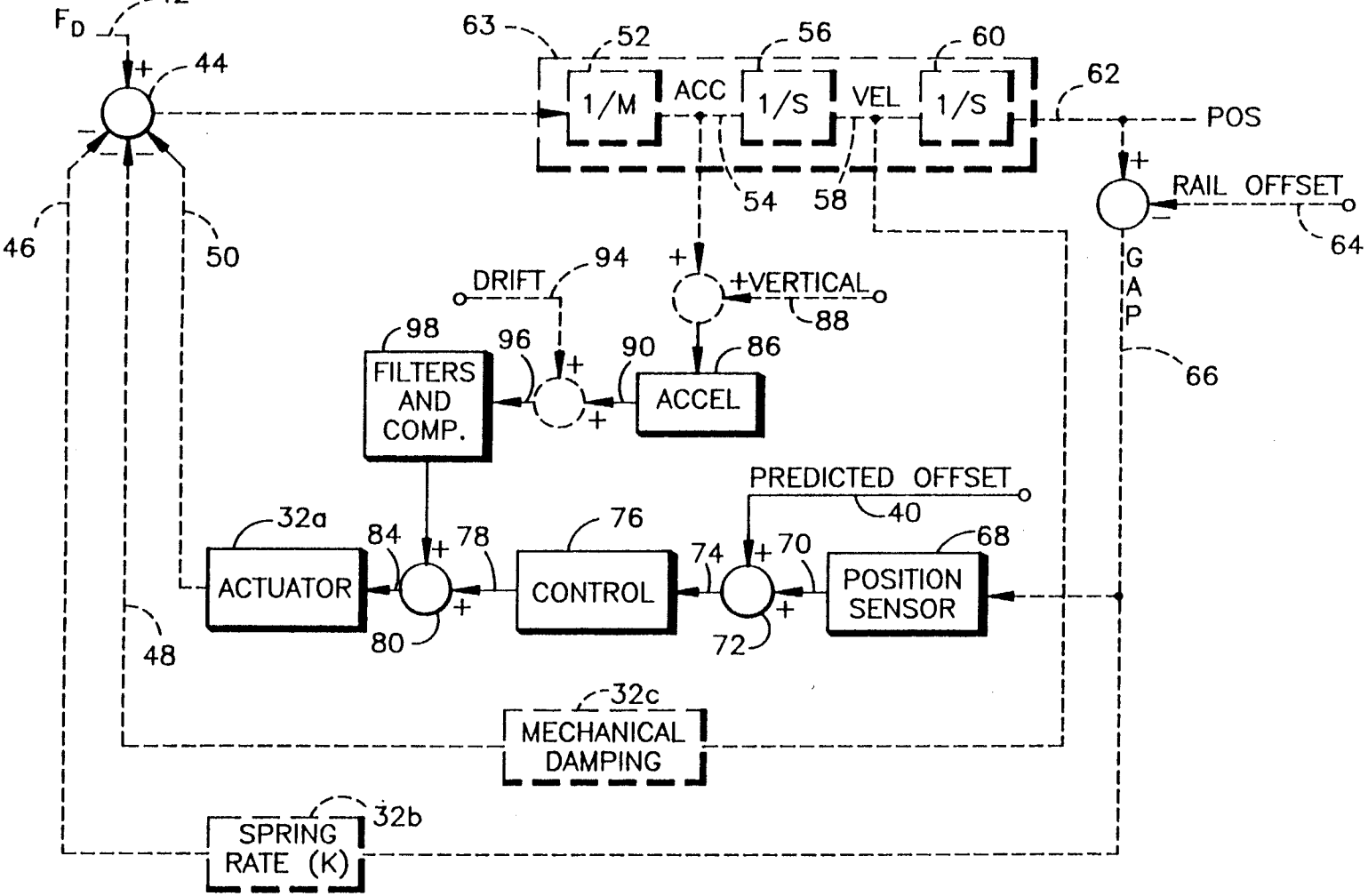
FIG. 3 shows retrieved rail profile data used with a position-based feedback loop according to the present invention.

Referring now to FIG. 3, a force disturbance ($F_D$) as indicated on a line 42 is summed in a junction 44 with a number of counteracting forces 46, 48, 50 together acting on an elevator car 52, having a mass (M) which is accelerated by the disturbing force as indicated on a line 54 and integrated by the elevator suspension system to produce a velocity as indicated on a line 58 and further integrated by the system to produce a change in position as indicated on a line 62. Although modeled in FIG. 3 as a rigid body for purposes of simplification, it will be realized that the blocks 52, 56, 60 are in reality a complex, nonlinear system which together may be represented otherwise as a single, nonrigid body "car dynamics" block 63. Furthermore, it should be realized that we will continue to show the simplified rigid body model herein for teaching purposes only. We also show some parts of FIG. 3 in dashed lines for teaching purposes to help the reader more easily distinguish the system model portions of the diagram from the hardware portions, namely, the sensors, signal conditioning and actuator shown in solid lines. This particular teaching aid is not repeated in similar diagrams appearing in FIG. 6 & 7 since the hardware portions of those diagrams may be easily distinguished from the modeled portions thereof in light of this teaching of FIG. 3.

The difference between the car position (POS) as indicated on a line 62 and the actual rail offset as indicated by a signal on a line 64 is indicated on a line 66 as a GAP signal provided to a position sensor 68 for sensing and acting through a spring rate (K) 32*b* of the actuable suspension 32.

The position sensor 68 provides a sensed signal on a line 70 to a junction 72 where it is summed with predicted offset signal 40 of FIG. 2 in order to provide a summed signal on a line 74 to a control 76 which in turn provides a control signal on a line 78 to a junction 80. The control 76 may be a simple proportional gain, proportional-integral gain or some other more complicated gain for forming an electronic spring to null the difference between the predicted position and the actual.

An acceleration based feedback loop provides a control signal on a line 82 to a junction 80 for summation with the signal on a line 78 to provide a summed signal on a line 84 to an actuator 32*a*, being part of the actuable suspension 32 of FIG. 4.

To form the feedback loop, an accelerometer 86 senses the acceleration as indicated by a line 54 but as possibly corrupted somewhat by a vertical component as indicated by a signal on a line 88. A sensed signal is thus provided on a line 90 to a junction 92 which sums in a drift component as is associated with all accelerometers to some degree. A resultant summed signal on a line 96 is provided to a filtering and compensation unit 98 which provides the acceleration-based feedback signal on the line 82 previously discussed. It should be realized that the scheme of FIG. 3 could, in fact, be used without an acceleration loop. In FIG. 3 it is presumed that load imbalances are taken care of by other means, e.g., by a separate, "slow" control loop. Such a loop is not shown here but is shown in the previously mentioned copending applications owned by the assignee hereof. The actuator 32*a* (force generator) shown here may be implemented, for example and without limitation, using a pair of small electromagnets capable of exerting forces on the order of a few hundred Newtons. In such a case, the greater forces required to counter load imbalances, typically on the order of a thousand or more Newtons, would be handled by another actuator. For a small actuator described here, one may, but need not, use a bandwidth of 100 rad/s (16 Hz). It should be realized, however, that the control used for handling rail induced anomalies and the centering control for handling load imbalances can act on the same actuator.

The inputs to the control are the actual rail offset and the predicted rail offset. The gap plus predicted offset gives the synthesized position. The objective of the control is to null the car position "POS" for an arbitrary rail offset by hulling on the synthesized position. Or, as suggested above, as another way of looking at it, the control has two inputs: the rail offset is the unwanted disturbance and the predicted offset is an injected signal used to null the rail offset.

The block 32c called "mechanical damping" may represent purely mechanical damping or mechanical plus electrically derived damping. A good damping signal can be derived from an accelerometer. The spring rate (K) 32b is adjusted to be small. This is comparable in stiffness to existing, i.e., passive roller guide springs.

Figure 5:
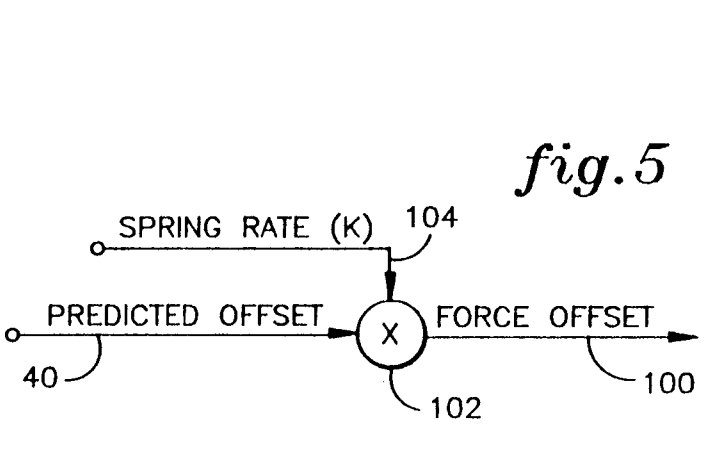
FIG. 5 shows multiplication of a retrieved rail profile signal by a spring constant to give a force offset signal for use as shown in FIG. 6 according to the present invention.

Referring now to FIG. 5, a force offset signal may be provided as shown on a line 100 by a multiplier 102 responsive to the predicted offset signal on a line 40 and a spring rate signal on a line 104 (having a magnitude indicative of the magnitude of the spring rate 32b shown in FIG. 3). The force offset signal on line 100 is useful for certain embodiments of the invention as shown below.

Figure 6:
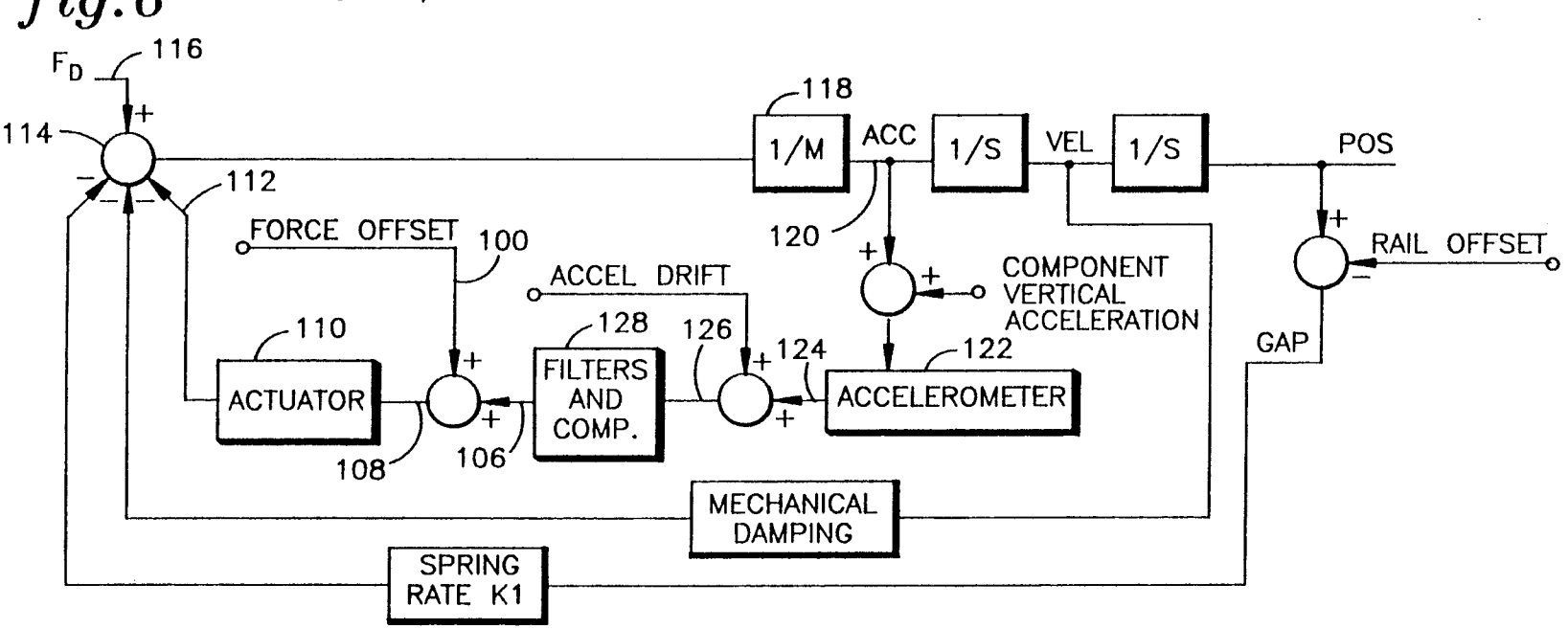
FIG. 6 shows the multiplied rail profile data of FIG. 5 used with an acceleration-based feedback loop.

For example, FIG. 6 shows the force offset signal on the line 100 summed with a force feedback signal on a line 106 in order to provide a summed signal on a line 108 for driving an actuator 110 for providing a counterforce as indicated on a line 112 for summation with similar counterforce signals in a summer 114 for counteracting a force disturbance indicated on a line 116 acting on an elevator car 118. An acceleration of the car as indicated by a line 120 is sensed by an accelerometer 122 as corrupted by a component of vertical acceleration, as discussed before in connection with FIG. 3. The accelerometer output is provided on a line 124 and is itself corrupted by a component of accelerometer drift, as previously discussed, and a signal is finally provided on a line 126 to a control unit 128 having filters and compensation for providing a force command signal on a line 106 having a magnitude calculated to counter the sensed acceleration. The open loop introduction of the force offset signal on the line 100 reduces the bandwidth requirements for the feedback loop to meet ride quality specifications by anticipating and countering disturbances due to rail anomalies that would otherwise cause unwanted accelerations.

Figure 7:
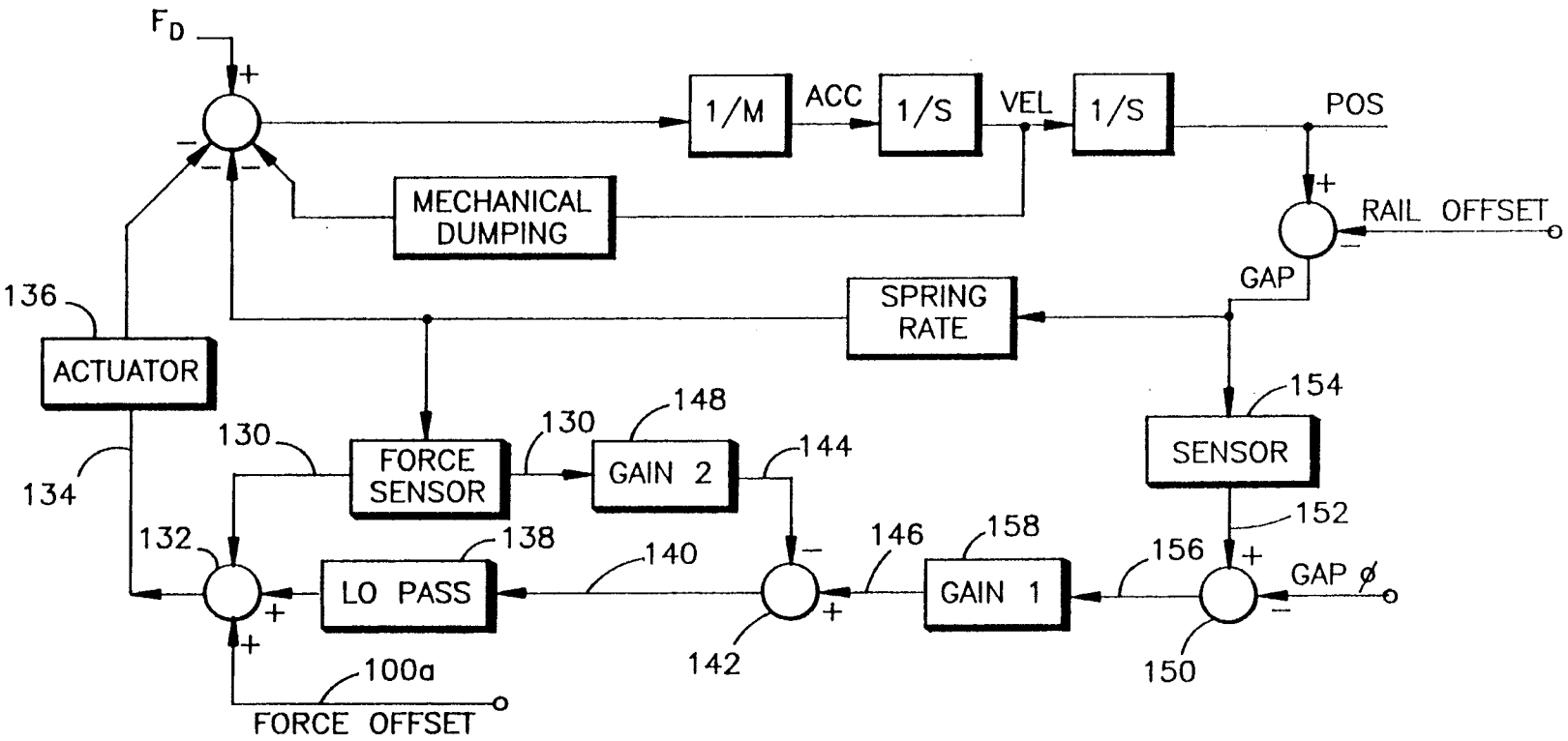
FIG. 7 shows the multiplied rail profile data of FIG. 5 used with a force-based feedback loop and an acceleration-based loop according to the present invention.

Referring now to FIG. 7, a concept similar to that shown in FIG. 6 is also shown, except that the force offset signal on a line 100a is compared with a sensed force signal on a line 130 by means of a summer 132 for providing a summed signal on a line 134 to an actuator 136.

For centering purposes, a low pass filter 138 is responsive to a difference signal on a line 140 provided by a summer 142 responsive to an amplified force signal on a line 144 and an amplified GAP difference signal on a line 146. The sensed force signal on the line 130 is provided to a signal conditioning unit 148 which provides the signal on the line 144. A summer 150 is responsive to a sensed GAP signal on a line 152 provided by a GAP sensor 154 and to a reference signal GAP0 and provides a difference signal on a line 156 to a signal conditioning unit 158 which in turn provides the signal on the line 146. This represents yet another way of combining an open loop, learned rail disturbance method with a closed loop feedback method.

Referring now to FIG. 8, it will be recalled from FIG. 6 that the force offset signal on the line 100 was summed with the force command signal on the line 106 in order to provide the summed signal on the line 108. The force offset signal was described as generated in accordance with the method shown in FIG. 5. However, we now show that the force offset signal may be generated in any number of different ways including, without limitation, those shown in FIGS. 5, 8 and 9.

Thus, in FIG. 8 we show that the learned rail information on the line 40 (retrieved from memory) may be provided to lookup a corresponding stiffness stored in a stiffness schedule 150 as a function of the rail offset. A stiffness signal on a line 152 is provided to a multiplier 154 for multiplication by a sensed position signal on a line 156 provided by a sensor 158 responsive to the GAP shown in FIGS. 4 and 6. The multiplier multiplies the magnitudes of the signals on the lines 152, 156 and thus provides the force offset signal on the line 100 in the manner indicated. This implementation may be used to reduce the effective stiffness of the suspension when traveling over rough rails and to increase it while traversing smooth rails.

Similarly, in FIG. 9 we show learned rail information used in conjunction with sensed sensor information to minimize car variations from a theoretical plumb line. The estimated rail irregularity signal on the line 40 is subtracted at a junction 160 from a sensed GAP signal on a line 162. A resultant signal on a line 164 effectively estimates the positional deviation of the car from the theoretical plumb line. I.e., the signal on line 164 represents the position of the car with respect to an "inertial" reference. The restoring force signal on the line 100 can be generated by providing the displacement signal on the line 164 to a position compensator 166 which stores a preselected stiffness for each possible magnitude of the signal on the line 164. This implementation could be used to increase the system stiffness via a synthesized electronic spring to a ground on a theoretical plumb line. I.e., the benefit of this arrangement is not only increased stiffness but vibration reduction.

Figure 1A:
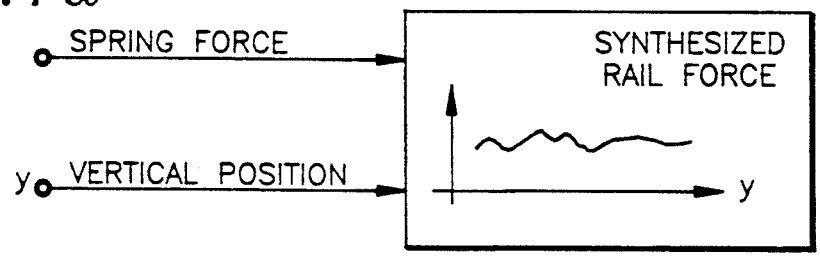
FIG. 1A shows another rail learning technique according to the present invention.
Figure 2A:
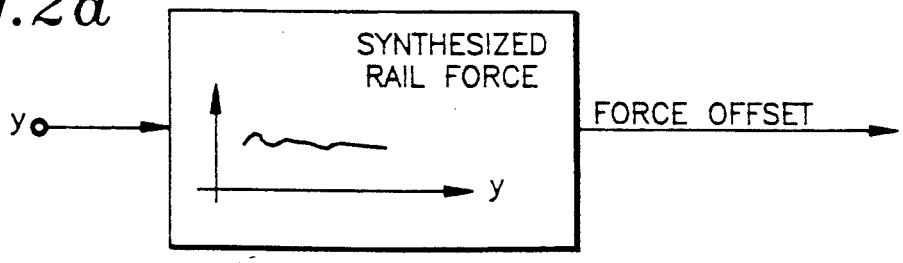
FIG. 2A shows retrieval of learned rail force data in response to a vertical position signal according to the present invention.

Referring now to FIG. 1A, it will be observed that rail learning may take other forms than disclosed thus far and we merely show one other technique for illustrating such other approaches without limiting our invention which is concerned not so much with the specific methods of learning the rail but with the idea of combining learned rail data with a feedback technique. Thus, in FIG. 1A we show an alternative method whereby a spring force is sensed as the car moves vertically in the hoistway. The sensed force is paired with a vertical position signal or pointer, which may be sensed, and stored to form a synthesized rail force offset lookup table. Since the force signal will be affected by load imbalances, by taking many vertical runs over many different loading conditions it will be possible to infer an average value of force attributable to rail anomalies. The average can then be stored and will be useable as an approximation of an appropriate force offset. FIG. 2A is similar to FIG. 2 in that a force offset signal useable in FIG. 6 or 7 is retrieved directly from memory in response to a vertical position signal.

Thus, it will be seen that the underlying concept of the present invention, i.e., using a learned, rail-related signal retrieved from a memory in conjunction with a feedback loop, which may be practiced in many different embodiments as shown but not limited thereby. For instance, although we show the retrieval of two different types of learned rail data, it should be realized that other types of data may be used as well. For still another example, by measuring and storing the horizontal positions of the car with respect to the rail for various vertical points along the length of the hoistway, e.g., by means of an LVDT, a result similar to that shown in FIG. 2A may be obtained. I.e., the multiplication of the measured or stored horizontal displacements by a presumed or known spring rate of the horizontal suspension will yield an indication of the force needed to counteract the force that can be expected to be imparted to the car due to rail anomalies. These indications may also be averaged over numerous vertical runs to take different loading conditions into effect. Thus, it will be understood by those skilled in the art that numerous other embodiments of the invention may be practiced according to the teachings hereof.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention.

We claim:

1. A control for guiding an elevator vertically along a rail by controlling an actuable horizontal suspension, comprising:

a learned rail characteristic control, responsive to a vertical position signal having a magnitude indicative of a vertical position of said elevator along said rail, for providing a learned rail characteristic signal having a magnitude indicative of a force offset at said vertical position; and a feedback control, responsive to said force offset signal and responsive to a sensed signal having a magnitude indicative of a force exerted against said elevator, for providing an actuating signal for actuating said actuable horizontal suspension to counter said force, wherein said learned rail characteristic signal indicative of force offset is provided by multiplying a stored predicted horizontal position signal by a spring rate.

2. A control for guiding an elevator vertically along a rail by controlling an actuable horizontal suspension, comprising:

a learned rail characteristic control, responsive to a vertical position signal having a magnitude indicative of a vertical position of said elevator along said rail, for providing a learned rail characteristic signal having a magnitude indicative of a force offset at said vertical position; and a feedback control, responsive to said force offset signal and responsive to a sensed signal having a magnitude indicative of a force exerted against said elevator, for providing an actuating signal for actuating said actuable horizontal suspension to counter said force, wherein said learned rail characteristic signal indicative of force offset is provided by multiplying a sensed gap signal by a stiffness signal retrieved from a memory in response to a predicted horizontal offset signal at said vertical position.

3. A control for guiding an elevator vertically along a rail by controlling an actuable horizontal suspension, comprising:

a learned rail characteristic control, responsive to a vertical position signal having a magnitude indicative of a vertical position of said elevator along said rail, for providing a learned rail characteristic signal having a magnitude indicative of a force offset at said vertical position; and a feedback control, responsive to said force offset signal and responsive to a sensed signal having a magnitude indicative of a force exerted against said elevator, for providing an actuating signal for actuating said actuable horizontal suspension to counter said force, wherein said learned rail characteristic signal indicative of force offset is provided by summing a sensed gap signal with a predicted offset signal for proving a summed resulting signal and by compensating the summed resulting signal for providing said force offset signal.

4. The control of claim 1, wherein said stored predicted horizontal position signal has a magnitude indicative of a sum of a signal having a magnitude indicative of the relative position of said elevator with respect to said rail and a doubly integrated acceleration signal having a magnitude indicative of said elevator's horizontal displacement from a vertical reference.

5. The control of claim 2, wherein said predicted horizontal offset signal is indicative of a sum of a signal having a magnitude indicative of the relative position of said elevator with respect to said rail and a doubly integrated acceleration signal having a magnitude indicative of said elevator's horizontal displacement from a vertical reference.

6. The control of claim 3, wherein said predicted offset signal is indicative of a sum of a signal indicative of said elevator's relative position with respect to said rail and a doubly integrated acceleration signal indicative of said elevator's horizontal displacement from a vertical reference.

* * * * *